US007240448B2

(12) United States Patent
Knapp

(10) Patent No.: US 7,240,448 B2
(45) Date of Patent: Jul. 10, 2007

(54) BEAN BAG BATON

(75) Inventor: Homer D. Knapp, North Hollywood, CA (US)

(73) Assignee: Less Lethal, Inc., Los Angeles, CA (US)

( * ) Notice: Subject to any disclaimer, the term of this patent is extended or adjusted under 35 U.S.C. 154(b) by 342 days.

(21) Appl. No.: 10/764,015

(22) Filed: Jan. 22, 2004

(65) Prior Publication Data

US 2005/0043101 A1 Feb. 24, 2005

Related U.S. Application Data

(60) Provisional application No. 60/497,356, filed on Aug. 21, 2003.

(51) Int. Cl.
*F41C 9/00* (2006.01)

(52) U.S. Cl. ..... 42/1.16; 89/1.42

(58) Field of Classification Search ..... 42/1.15, 42/1.16; 89/1.42, 1.4
See application file for complete search history.

(56) References Cited

U.S. PATENT DOCUMENTS 2,099,993 A 11/1937 Tauschek ..... 42/106
2,634,535 A * 4/1953 Borders ..... 42/1.08
3,708,902 A 1/1973 Foster et al. ..... 42/69.01
4,489,515 A 12/1984 Numbers ..... 42/70.01
4,644,930 A * 2/1987 Mainhardt ..... 124/58
4,722,148 A 2/1988 Walker ..... 42/69.01
5,135,151 A 8/1992 Logan ..... 227/9
5,364,097 A 11/1994 Lyon ..... 42/1.16
6,463,688 B1 10/2002 Idehara ..... 42/1.16

* cited by examiner

*Primary Examiner*—Stephen M. Johnson
(74) *Attorney, Agent, or Firm*—Fulbright & Jaworski LLP

(57) ABSTRACT

A projectile weapon, preferably adapted to fire non- and less-lethal munitions. An elongate tubular body includes a barrel portion and a receiver portion, with a breech assembly disposed in the receiver portion adjacent the barrel portion. A handle is affixed to and extends outward from the receiver portion. A firing mechanism is disposed within the receiver portion adjacent the breech assembly. A trigger is adapted to slide in a longitudinal direction along the elongate tubular body. The trigger extends outward from the receiver portion in a direction generally parallel to the handle. The trigger is slidable between at least a deployed position and a retracted position. In the deployed position, the trigger assembly is adapted to actuate the firing mechanism. In the retracted position, the trigger face is recessed into the handle.

37 Claims, 7 Drawing Sheets

BEAN BAG BATON

PRIORITY

This application claims priority under 35 U.S.C. § 119(e) to U.S. Provisional Application No. 60/497,356, filed on Aug. 21, 2003, the disclosure of which is incorporated herein by reference.

BACKGROUND OF THE INVENTION

1. Field of the Invention

The field of the present invention is projectile weapons, and in particular dual-use projectile weapons which fire non-lethal and less-lethal munitions.

2. Background

In certain situations, law enforcement officers or military personnel are required to use force to control crowds or certain individuals. Preferably, the control devices employed are designed to minimize bodily injury caused to the individuals against whom they are used.

Traditionally, the only options available have been firearms, chemical agents, and batons or clubs. The use of firearms, however, always raises the possibility of an unintended fatality. As to chemical agents, they may also cause unintended results if the person or persons they are directed towards have high or unusual sensitivities to the chemicals used. The disadvantage presented by the use of batons or clubs is that close physical engagement is required, and generally, close physical engagement is undesirable.

Currently, shoulder weapons, such as shotguns or rifles, are typically used to deploy kinetic non- and less-lethal munitions. However, during routine patrols, law enforcement and military personnel generally do not carry such weapons. Therefore, when the use of non-lethal force becomes tactically desirable, close physical engagement is the only option unless the weapon having the non- or less-lethal munitions is at hand. Unfortunately, most law enforcement and military personnel do not typically carry such weapons on their person.

As a solution to this problem, dual-use equipment for law enforcement and military personnel has been introduced. The baton is one of the more common pieces of equipment to be converted for dual-use. One of the most basic forms of the baton has an elongate cylindrical main body and a rigidly attached transverse handle positioned approximately one-fourth (¼) of the overall longitudinal length from one end. This basic design may be modified to include additional features, imparting greater functionality as compared to a conventional baton.

U.S. Pat. No. 5,529,300 discloses one example of a dual-use baton by incorporating a self-powered extensible projectile launching police baton. A hollow telescopic ram that is shorter than the barrel portion of the baton is positioned within the barrel of the baton. The ram may be driven out of the barrel of the baton by pressurized gas from an explosive cartridge mounted within the barrel. Thus, the ram member is extendible and fully retractable within the barrel of the baton. The front tip of the extensible ram is blunt or is deformable to reduce the impact when the ram hits an object or a person, thereby reducing the possibility of serious injury.

U.S. Pat. No. 5,364,097 discloses another example of a dual-use baton. The elongate body of the '097 patent includes a launching barrel and a breech end which houses a firing mechanism and a recessed trigger for launching a projectile positioned within the launching barrel. This baton is capable of firing non- and less-lethal projectiles or tear gas to subdue persons or crowds at a reasonably safe distance.

U.S. Pat. No. 6,400,688, the disclosure of which is incorporated herein by reference, discloses yet another example of a dual-use baton. This baton includes a barrel body which is pivotally connected to a breech body, with a handle secured to the breech body. The trigger for the firing mechanism is located between the handle and the end of the breech body. The trigger must be pushed towards the handle to actuate the firing mechanism. The trigger may also be pivoted and locked into a longitudinal position along the breech body. Stowing the trigger in such a position allows for normal use of the baton without interference from the trigger or accidental firing.

SUMMARY OF THE INVENTION

The present invention is directed towards a projectile weapon, and in particular a projectile weapon having a dual-use, the second use being as a baton. An elongate tubular body comprises a barrel portion and a receiver portion. The receiver portion includes a breech assembly disposed adjacent the barrel portion. A handle is affixed to the receiver portion, extending outward from the elongate tubular body. A firing mechanism is disposed within the receiver portion of the elongate tubular body adjacent the breech assembly. A trigger assembly is adapted to slide longitudinally along the elongate tubular body and to actuate the firing mechanism.

In a first separate aspect of the present invention, the trigger assembly is slidable between a deployed position and a retracted position. When the trigger assembly is in the deployed position, the trigger assembly is adapted to actuate the firing mechanism. When the trigger assembly is in the retracted position, the trigger face is recessed into the handle. Preferably, the trigger assembly is securable in the retracted position, thus removing the trigger face from interfering with use of the weapon as a baton and providing a safety feature.

In a second separate aspect of the present invention, the trigger assembly is adapted to actuate the firing mechanism via a reverser mechanism disposed within the receiver portion of the elongate tubular body. The reverser mechanism is coupled to both the trigger assembly and the firing mechanism such that the trigger assembly actuates the reverser mechanism and the reverser mechanism actuates the firing mechanism. Preferably, the reverser mechanism actuates the firing mechanism only when actuated by the trigger assembly. Optionally, the reverser mechanism may be releasably coupled to the trigger assembly, allowing the trigger assembly to slide without actuating the firing mechanism. As another option, the reverser mechanism may comprise a rack and pinion system, with a first rack being coupled to the trigger assembly, a second rack being coupled to the firing mechanism, and the pinion being disposed between and engaging the two racks.

In a third separate aspect of the present invention, the breech assembly is adapted to pivot outward from a first side of the elongate tubular body and the handle is affixed to a second side thereof. The breech assembly is pivotable between at least a closed position, in which the breech assembly is adapted to position ammunition adjacent the firing mechanism, and an open position for loading and unloading ammunition.

In a fourth separate aspect of the present invention, any of the foregoing aspects may be employed in combination.

Accordingly, it is an object of the present invention to provide an improved projectile weapon. Other objects and advantages will appear hereinafter.

BRIEF DESCRIPTION OF THE DRAWINGS

In the drawings, wherein like reference numerals refer to similar components.

DETAILED DESCRIPTION OF THE PREFERRED EMBODIMENTS

Figure 1:
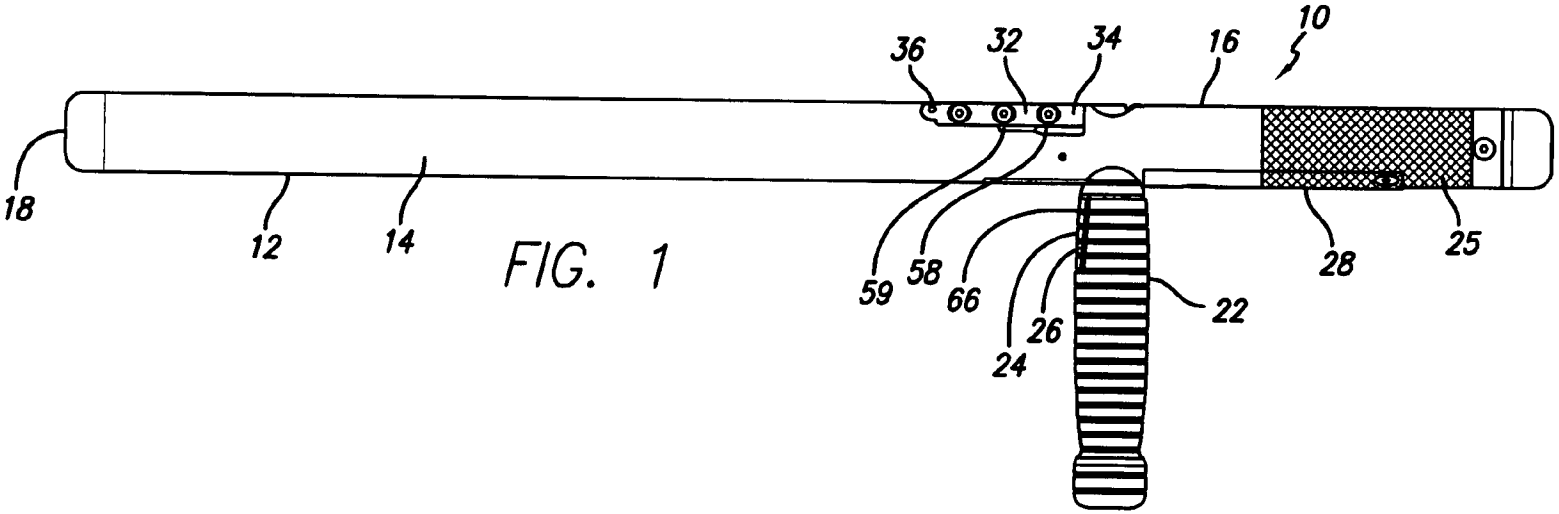
FIG. 1 is a side elevational view of an embodiment of a projectile weapon.
Figure 2:
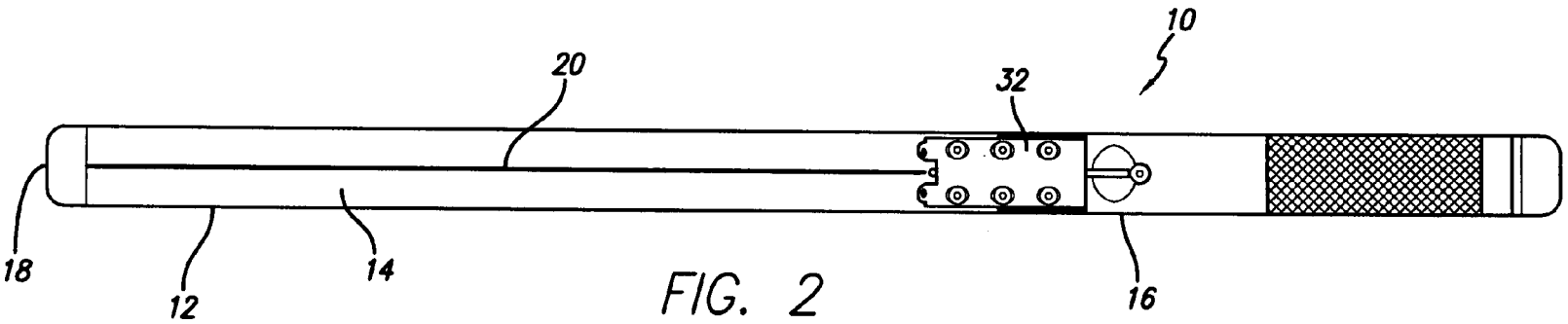
FIG. 2 is a top plan view of the projectile weapon of FIG. 1.
Figure 3:
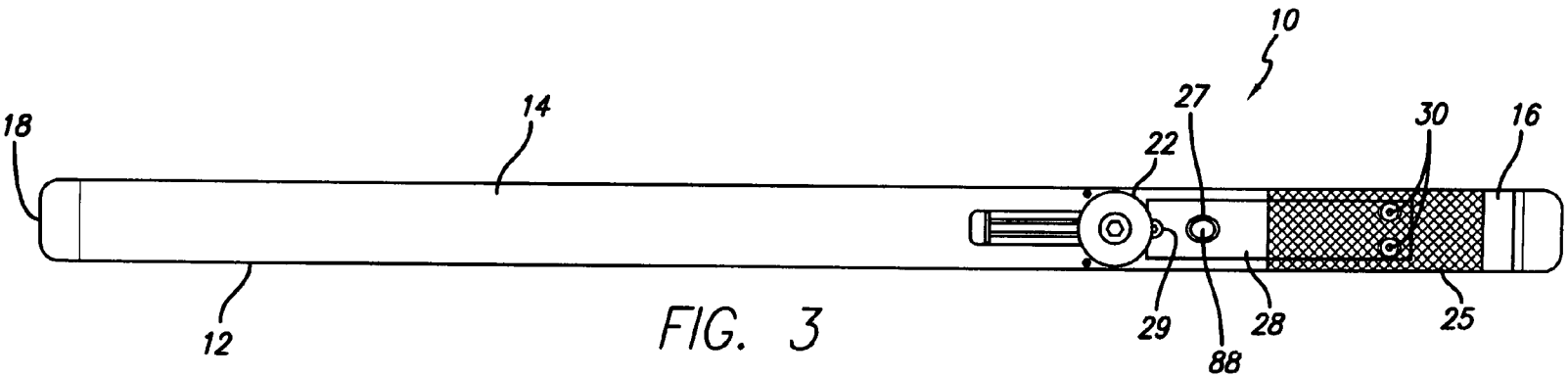
FIG. 3 is a bottom plan view of the projectile weapon of FIG. 1.

Turning in detail to the drawings, FIGS. 1–3 illustrate side, top, and bottom views, respectively, of a projectile weapon 10 having the form of a common police baton. An elongate tubular body 12 includes a barrel portion 14 and a receiver portion 16. The muzzle end 18 of the barrel portion 14 is open to allow discharge of one or more projectiles (not shown) from an ammunition cartridge. The barrel portion 14 includes a longitudinal groove 20 running along the outer surface of the elongate tubular body 12. The groove 20 provides a sight-line for aiming the projectile weapon 10. The bore of the barrel portion 14 may be rifled in a manner commonly practiced in the art. The bore size of the barrel portion 14 is appropriately sized for the munitions used.

Figure 11:
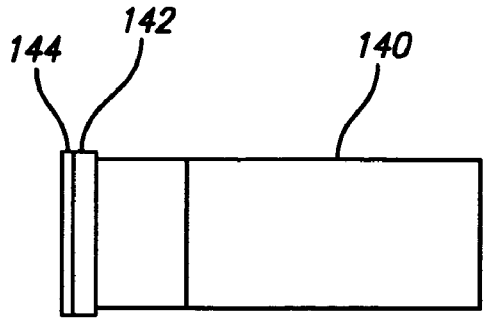
FIG. 11 is a side elevational view of a less lethal safety ammunition cartridge.

The projectile weapon 10 is adapted to fire safety modified less-lethal ammunition, such as is manufactured by MK Ballistic Systems of Hollister, Calif., and is illustrated in FIG. 11. The bore of the barrel portion 14 is sized accordingly. Other sizes and types of ammunition may be employed with the projectile weapon modified appropriately to accommodate the desired ammunition.

A handle 22 is rigidly affixed to the receiver portion 16, extending outward from the elongate tubular body 12 in a generally perpendicular direction. As shown, the handle 22 is on an opposite side of the elongate tubular body 12 from the groove 20. The relative orientation of the handle 22 and the groove 20, however, may be changed as desired.

A trigger assembly 24 (partially shown in FIGS. 1 and 4) includes a trigger face 66 which extends outward from the elongate tubular body 12 in a direction substantially parallel to the handle 22. In FIG. 1, the trigger assembly 24 is in the retracted position, with the trigger face 66 stowed in a recess 26 in the handle 22. With the trigger face 66 thusly stowed, the projectile weapon 10 may be used as a baton with little or no interference from the trigger face 66. The ability to stow the trigger face 66 in the recess 26 also serves as a safety feature of the projectile weapon 10.

Figure 4:
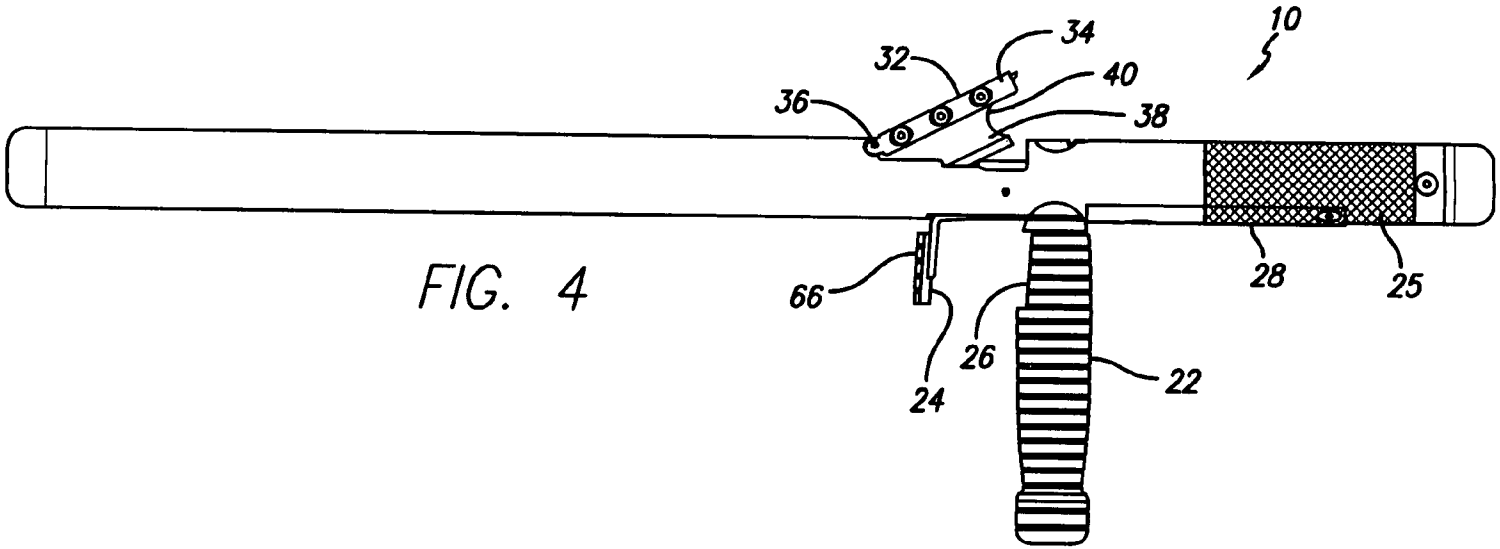
FIG. 4 is a side elevational view of the projectile weapon of FIG. 1, the weapon having the trigger assembly in the deployed position and the breech assembly in the open position.

In FIG. 4, the trigger assembly 24 is in the deployed position. With the trigger assembly 24 is in the deployed position, the trigger face 66 may be slid towards the handle 22 to fire the projectile weapon 10. The selector mechanism 81 by which the trigger assembly 24 is slidable between the deployed and retracted positions and by which the trigger assembly 24 is actuated to fire the projectile weapon 10 is detailed below.

Referring again to FIGS. 1–3, the receiver portion 16 includes a knurled surface 25 as a grip. The receiver portion 16 also includes an access panel 28 which is affixed by counter-sunk screws 29 and 30 as shown in FIG. 3. Removal of the access panel 28 facilitates access to the internal mechanisms, discussed in detail below, for assembly, disassembly, or service.

The receiver portion 16 includes a receiver cavity 31, an articulated breech assembly 32, a breech block 46, a firing mechanism 74, a reverser mechanism 78, a selector mechanism 81 and a trigger assembly 24. The breech assembly 32 includes a receiver door 34, which is hingedly affixed to the elongate tubular body 12 at a hinge point 36, and a cylindrical breech chamber 38 affixed to the receiver door 34. When the breech assembly 32 is closed, as shown in FIG. 1, the longitudinal axis of the breech chamber 38 is aligned with the longitudinal axis of the elongate tubular body 12, thus ammunition is appropriately positioned for discharge when the projectile weapon 10 is fired. When the breech assembly 32 is open, as shown in FIG. 4, the breech chamber 38 is accessible for both removing spent ammunition and inserting live ammunition. The rear end of the breech chamber 38 distal from the barrel portion includes semicircular finger cut-outs 40 which enable a user to grip and extract ammunition.

The inner diameter of the breech chamber 38 is sized to receive the desired munitions. For many non- and less-lethal munitions, the diameter of the bore will generally be slightly smaller than the diameter of the breech chamber 38. Other munitions may require different relative diameters of the bore and the breech chamber 38.

Figure 5:
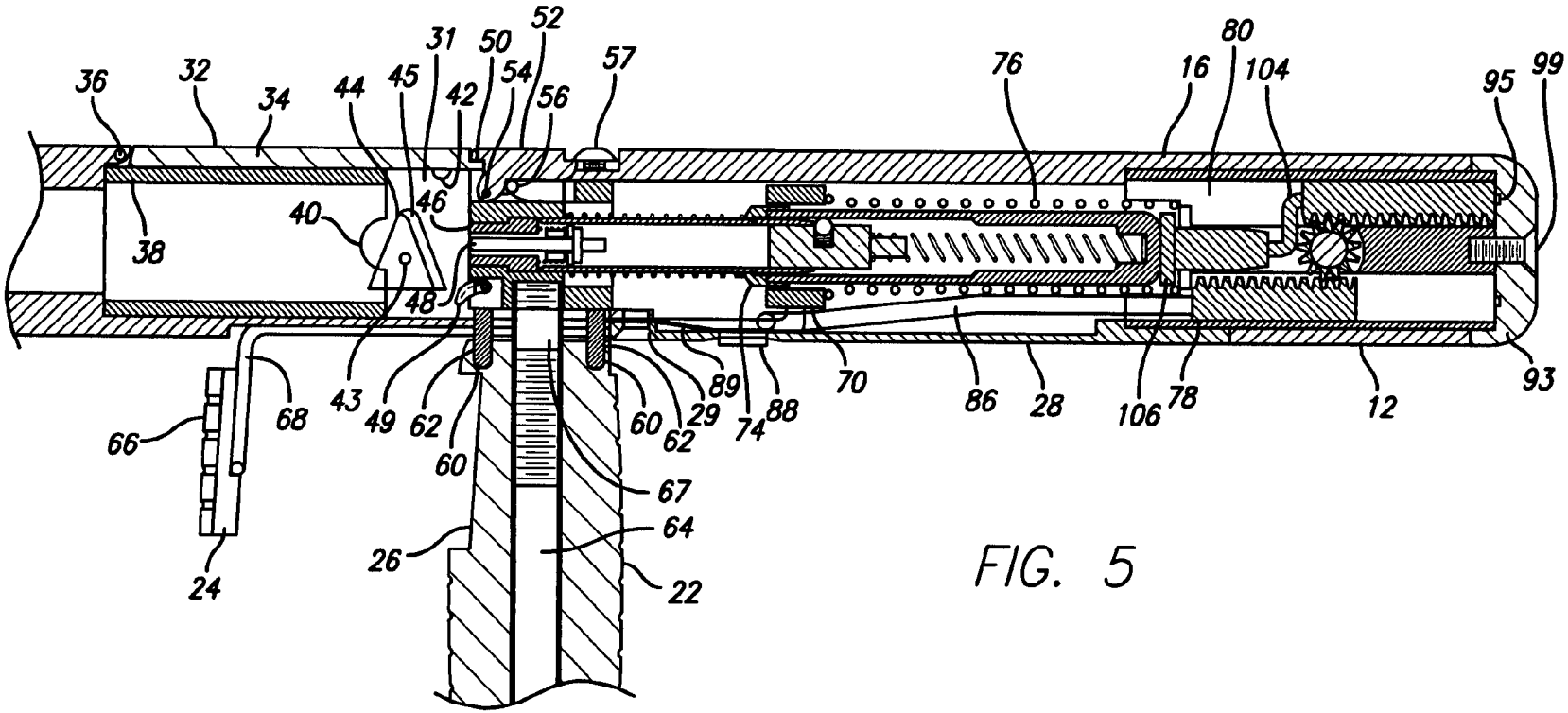
FIG. 5 is a partial cross-sectional view of the projectile weapon along the line 5—5 of FIG. 3.

The longitudinal length of the breech chamber 38 allows the breech assembly 32 to be pivoted from the open position to the closed position with a round of ammunition loaded without the breech chamber 38 or the head of the loaded ammunition catching on the upper rear edge of the receiver cavity 31. Referring to FIG. 5, head-spacing ramps 44 are affixed to the interior surface of the receiver cavity 31 rearward of the breech chamber 38 when the breech assembly 32 is closed. Each head-spacing ramp 44 includes at its rear inner edge a beveled surface 45 for guiding ammunition loaded into the breech chamber 38 into proper position for firing as the breech assembly 32 is pivoted into the closed position. As the breech assembly 32 is closed, the beveled surfaces 45 of the head-spacing ramps 44 engage the circumferential safety ring of the loaded round of ammunition (shown in FIG. 11) and draw the striking surface of the round toward the breech block 46, which houses the striker 48.

In the projectile weapon 10 illustrated, a safety mechanism is included to permit discharge of only specially prepared ammunition cartridges. As described below, the travel of the striker 48 is limited and is designed to extend a certain distance past the face of the breech block 46. The head-spacing ramps are positioned to prevent drawing standard 12 gauge ammunition toward the breech block 46 within reach of the fully extended striker 48. Further, the breech block 46 includes a spring-biased lever, referred to as the safety lock-out finger 49, which limits rearward motion of standard ammunition in the breech chamber 38. This safety lock-out finger 49 prevents the fully extended striker 48 from contacting standard 12 gauge ammunition. Thus, a projectile weapon which includes the safety mechanism will not discharge standard lethal ammunition.

As previously indicated, the projectile weapon 10 is adapted to discharge less lethal safety ammunition cartridges that are similar in size and shape to standard 12 gauge less lethal cartridges. FIG. 11 illustrates a less lethal safety ammunition cartridge 140, which is essentially a standard 12 gauge less lethal cartridge having a circumferential safety spacing ring 142 disposed about the cartridge in front of the circumferential flange 144. The safety spacing ring 142 allows the ammunition to be drawn directly next to the breech block by the head-spacing ramps 44 when the cartridge is loaded into the breech chamber 38, depressing the spring biased safety lock-out finger downward as the breech assembly 32 is closed. In this position, the loaded ammunition may be impacted by the striker 48 upon actuation thereof.

When the breech assembly 32 is pivoted from the closed position to the open position, the spent ammunition casing (or the unfired live ammunition) is forced further into the breech chamber 38 by sliding against the breech block 46. As the breech assembly 32 reaches its fully open position, the ammunition is returned to the same position, relative to the breech chamber 38, it was in when initially loaded.

The receiver door 34 includes a spring wire detent 42 positioned to prevent loaded ammunition from falling out of the breech chamber 38 if the weapon 10 is jostled or upended, while the breech assembly 32 is in the open position. The receiver door 34 also includes a tongue 50 which engages a latch 52 to maintain the receiver door 34 in the closed position. Preferably, the top surface of the tongue 50 is inclined at approximately a 5° angle away from the longitudinal axis of the elongate tubular body 12, the rear edge of the top surface being further away from the longitudinal axis than the forward edge when the receiver door 34 in its closed position. The bottom surface of the latch 52 that engages the tongue 50 is inclined at a complimentary 40° angle. The latch 52 is hingedly attached to the breech block 46 about a hinge point 54 and is biased by a spring 56 to secure the receiver door 34 in the closed position. The contact point of the tongue 50 and the latch 52 is rearward of a vertical line upward from the hinge point 54. The rear portion of the latch 52 abuts the underside of a stop screw 57 secured to the elongate tubular body 12, the stop screw 57 limiting the pivotal movement of the latch 50. Thus, by pressing near the rear of the latch 52 towards the longitudinal axis of the elongate tubular body 12, the latch 52 releases the tongue 50 and allows the receiver door 34 to be moved to the open position. Preferably, the receiver door 34 is spring biased to remain in the open position when not latched in the closed position.

Referring again to FIG. 1, finger gaps 58 are included between the rear edges of the receiver door 34 and the elongate tubular body 12 to enable a user to grip and open the receiver door 34 in the event the door is jammed in the closed position by an overly expanded munition casing or by foreign material such as powder residue or wadding from spent munitions. In the event the breech assembly 32 is more severely jammed in the closed position, small slots 59 forward of the finger gaps are included between the receiver door 34 and the elongate tubular body 12. These small slots 59 are sized to accept a flat tool, such as a coin or a flat blade screwdriver, to facilitate opening the breech assembly 32.

As depicted, the breech assembly 32 is disposed on and pivots away from the elongate tubular body 12 on a side opposite the handle 22. This relative orientation between the handle 22 and the breech assembly 32 is a matter of design choice and may be changed as desired.

Figure 6:
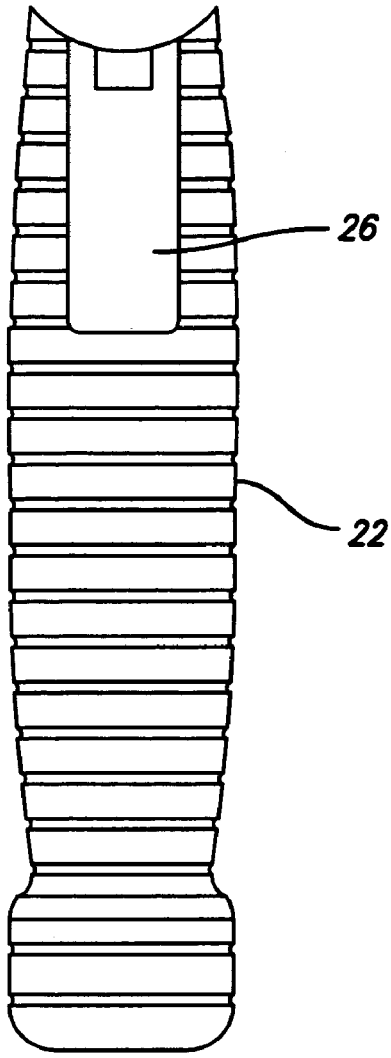
FIG. 6 is a front elevational view of the handle.

Returning to FIG. 5, the elongate tubular body 12 includes two outward extending stabilizing pins 60 which are inserted into complimentary receptacles 62 in the handle 22. As shown in FIG. 6, the end of the handle 22 that is affixed to the elongate tubular body 12 has a generally arcuate shape to conform to the outer surface of the elongate tubular body 12. A bolt 64 passes through the length of the handle 22, through the side wall of the elongate tubular body 12, and threadably engages the breech block 46 to affix the handle 22 to the elongate tubular body 12. Where the bolt 64 passes through the side wall of the elongate tubular body 12, a sleeve 67 is placed over the bolt 64 to prevent the threads of the bolt 64 from damaging the elongate tubular body 12 due to recoil when the projectile weapon 10 is fired.

The portion of the trigger 24 that extends outward from the elongate tubular body 12 includes the trigger face 66 affixed to trigger rails 68. The trigger face 66 provides a suitable surface for one or more of a user's fingers to actuate the trigger assembly 24 when firing the weapon. The two trigger rails 68 stabilize the trigger 66. The trigger rails 68 are formed from a single piece of material that is suitably rigid, such as ⅛" piano wire, the material being bent back upon itself at the trigger face 66 to form the two parallel trigger rails 68.

The two trigger rails 68 extend rearward from the trigger face 66 submerged within grooves along the outer surface of the elongate tubular body 12. The two trigger rails 68 pass under the handle 22 and into the interior of the receiver portion 16 where they are affixed to a trigger stabilizing ring 70. Where the trigger rails 68 extend along the elongate tubular body 12, the grooves act as both a guide for the trigger rails 68 and allow the trigger rails 68 to enter into the interior of the elongate tubular body 12 without being offset. The grooves preferably provide sufficient clearance to allow the trigger rails 68 to slide freely in the longitudinal direction along the elongate tubular body 12 while prohibiting significant movement in any non-longitudinal direction.

The trigger stabilizing ring 70 encircles part of the firing mechanism 74 within the interior of the receiver portion 16. The outer diameter of the trigger stabilizing ring 70 is somewhat smaller than the inner diameter of the receiver portion 16, while the inner diameter of the trigger stabilizing ring 70 is somewhat greater than the outer diameter of the firing mechanism 74, thus allowing the trigger stabilizing ring 70 free longitudinal movement within the interior of the receiver portion 16. The trigger return spring 76 engages the rear face of the trigger stabilizing ring 70 and also encircles the firing mechanism 74. The opposite end of the trigger return spring 76 seats in the housing 80 of the reverser mechanism 78.

Figure 7A:
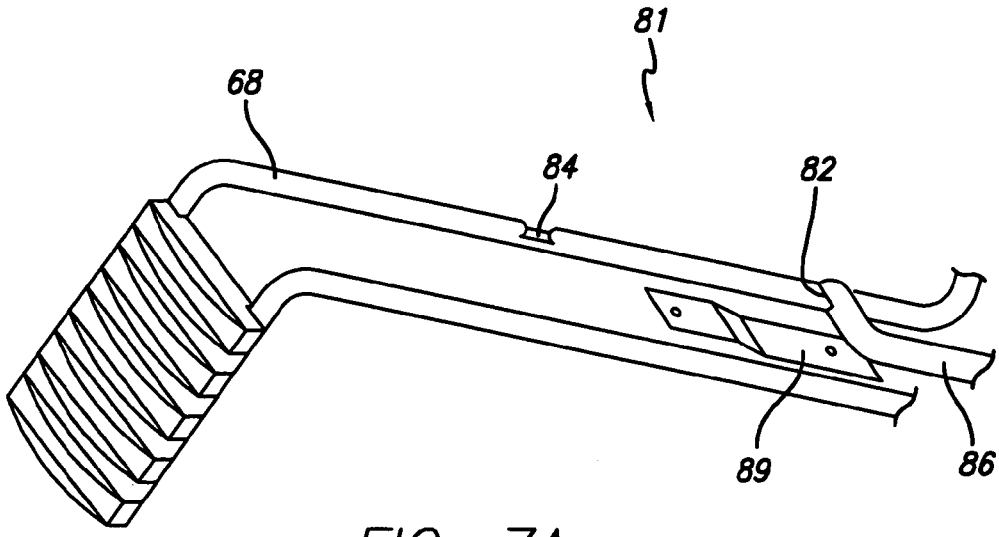
FIGS. 7A & 7B are perspective views of a selector mechanism for placing the trigger assembly in the firing position and in the safety position, respectively.
Figure 7B:
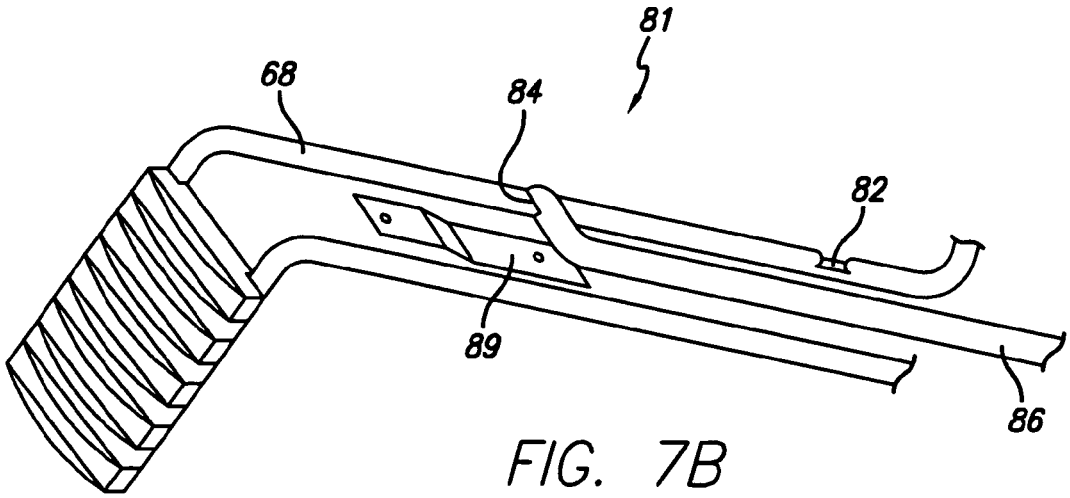

As part of the selector mechanism 81 within the receiver portion 16, one of the trigger rails 68 includes a first notch 82 which is employed to secure the trigger assembly 24 in the deployed position and a second notch 84 which is employed to secure the trigger assembly 24 in the retracted position. The reverser mechanism 78, which is disposed at the rear of the receiver portion 14, includes a leg 86 extending therefrom to engage either the first notch 82 or the second notch 84. FIG. 7A illustrates the leg 86 engaging the first notch 82, which would place the trigger 24 in the deployed position as described above. FIG. 7B illustrates the leg 86 engaging the second notch 84, which would place the trigger 24 in the retracted position as described above. A button 88 is secured to a thin, flexible arm 89 which is affixed between the elongate tubular body 12 and the access panel 28 with the screw 29. The arm 89 is positioned to disengage the leg 86 from the notches in the trigger rail 68 when the button 88 is pushed. As seen in FIG. 3, the button 88 is accessible through a hole 27 in the access panel 28.

Returning to FIG. 5, when the leg 86 is disengaged from either of the notches in the trigger rail 68, the trigger 24 is slidable between the deployed position and the retracted position without firing the projectile weapon 10. The trigger return spring 76 resists all trigger movement towards the handle 22. Therefore, when the leg 86 is disengaged from the second notch 84, the trigger return spring 76 forces the trigger 24 into the deployed position. With the first notch 82 engaged, trigger motion towards the handle 22 is also resisted by the trigger return spring 76. Such motion, if of sufficient distance, actuates the reverser mechanism 78, which in turn actuates the firing mechanism 74 and fires the projectile weapon 10. After the projectile weapon 10 is fired, the trigger return spring 76 returns the trigger 24 to the deployed position.

Figure 9:
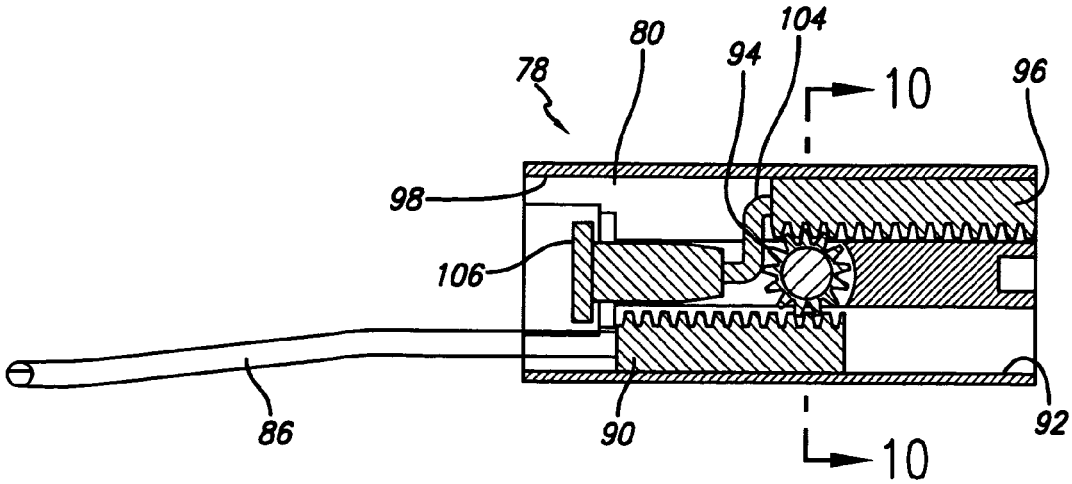
FIG. 9 is a detail cross-sectional view of the reverser mechanism.
Figure 10:
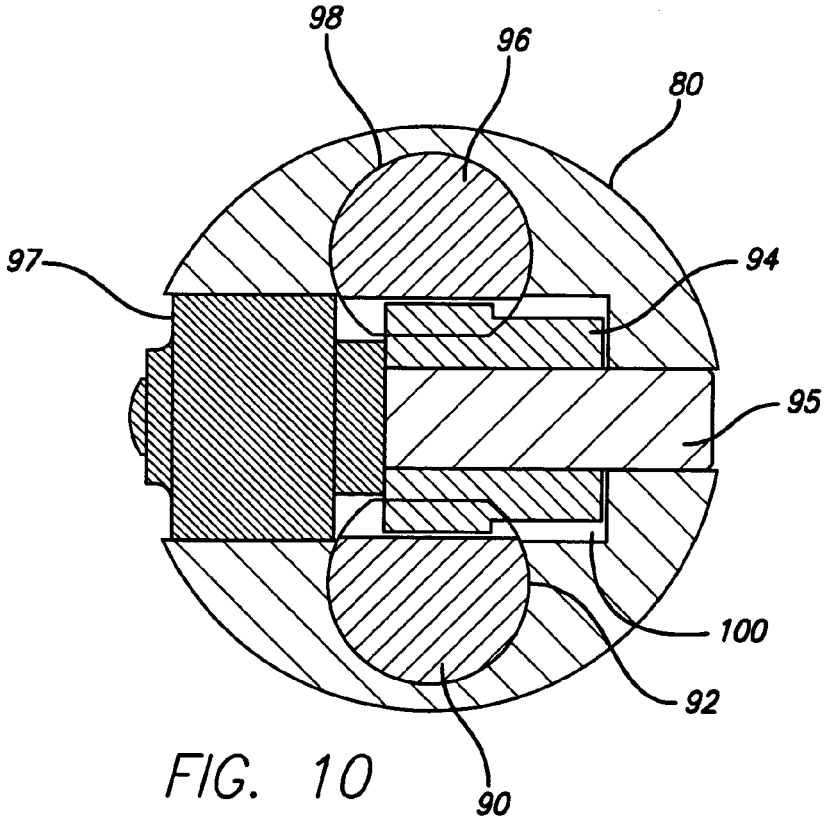
FIG. 10 is a cross-sectional view of the reverser mechanism along the line 8—8 of FIG. 5.

FIGS. 9 and 10 illustrate the reverser mechanism 78, which reverses the rearward motion of the trigger 24 into forward motion appropriate for actuating the firing mechanism 74. In FIG. 9, the leg 86 that engages the trigger rails is affixed to a driving rack 90 disposed within a first bore 92 in the housing 80 of the reverser mechanism 78. The driving rack 90 engages a pinion 94, which in turn engages a driven rack 96. The driven rack 96 is disposed within a second bore 98 within the housing 80 of the reverser mechanism 78, and the pinion is disposed within a third bore 100. The end cap 93 (shown in FIG. 5), affixed to the elongate tubular body 12 with the screw 99, acts as a travel stop for the driven rack 96 when the reverser mechanism 78 is in the at rest position as shown. The end cap 93 includes a small circular groove 95 on the surface abutting the reverser housing. When the driven rack 96 stops against the end cap 93, the circular groove 95 allows displacement of excess lubricating fluid, if present. Without such a groove, excess lubricating fluid may slow the motion of the driven rack 96.

The third bore 100 is perpendicular to and intersects the first two bores 92, 98 so that the pinion 94 may engage each of the two racks 90, 96. The third bore 100 is also open to the exterior of the housing 80 for insertion of the pinion 94 therein. This third bore 100 extends past the first two bores 92, 98 within the housing 80 and reduces to the axle diameter to seat one end of the pinion axle 95. An axle carrier 97, into which the other end of the pinion axle 95 is press fit, is disposed within the larger diameter portion of the third bore 100.

Returning to FIG. 5, the length of the driven rack 96 is such that a full length of travel along the pinion 94 is sufficient to actuate the firing mechanism 74. A leg 104 having a contact pad 106 at one end thereof with a concave face extends from the driven rack 96. The contact pad 106 engages the convex end of the firing mechanism 74. When the reverser mechanism 78 is actuated by the complete rearward motion of the trigger assembly 24, the contact pad 106 actuates the firing mechanism.

Figure 8:
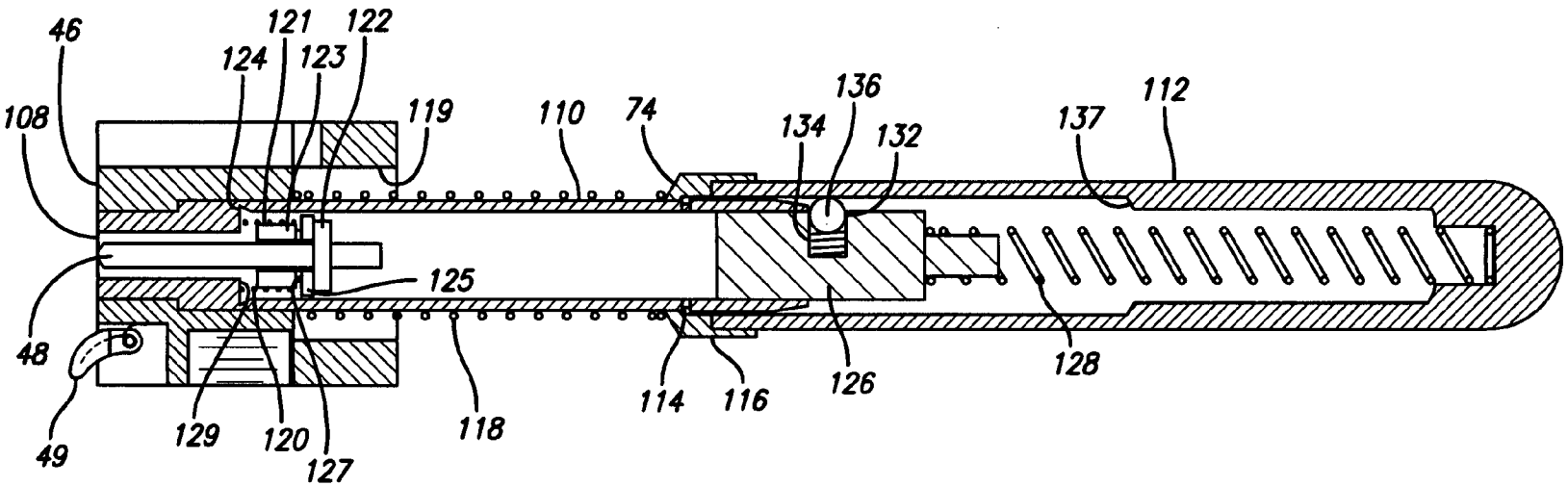
FIG. 8 is a detail cross-sectional view of the firing mechanism.

The firing mechanism 74, shown in FIG. 8, is a slightly modified version of a commercially available HeliCoil® thread repair insert tang removal tool, such as are manufactured by Emhart Teknologies, having an office in Irvine, Calif., with the primary modification being in the structure that biases the position of the striker 48. The firing mechanism 74 includes a two-part housing having a generally tubular shape. The outer diameter of the first section of housing 110 is less than the inner diameter of the second section of housing 112. Thus, the first section of housing 110 is slidable into the second section of housing 112. The first section of housing 110 includes a flange 114 against which a nut 116 bears. The Nut 116 threadably engages the second section of housing 112 and prevents the two sections 110, 112 from separating.

The first section of housing 110 extends through the center of and is affixed to the breech block 46. The breech block 46 maintains the firing mechanism 74 in the approximate diametric center of the breech chamber 38 when the breech assembly 32 is in the closed position. A spring 118 is disposed about the first section of housing 110, the forward end of the spring 118 seated within a recess 119 in the breech block 46 and the rear end seated against the nut 116. The spring 118 returns the two sections of housing 110, 112 to a longitudinally extended position after actuation.

The forward end of the first section of housing 110 is flush with the edge of the breech block 46 nearest the breech assembly 32. This end of the first section of housing 110 includes an aperture 108 through which the striker 48 extends when the weapon 12 is fired. A spring 120 encircles the striker 48 within the first section of housing 110. The striker includes a sleeve 121 press fit about the striker 48 forward of a circumferential flange 122. The sleeve 121 includes three sections of varied diameters. The forward section 123 limits the forward travel of the striker 48 by butting against a shoulder 129 within the first section of housing 110 when the striker is thrust forward into the breech chamber 38 upon firing. The middle section 127 is disposed between the forward and rearward sections 123, 125 and has a smaller diameter forming a groove therebetween to seat the rearward end of the spring 120. The forward end of the spring 120 seats within the undercut 124. The spring 120 returns the head of the striker 48 to just rearward of the forward edge of the breech block 46 following actuation.

The second section of housing 112 is open at the end it engages the nut 116 and closed at the opposite end. The convex end is engaged by the concave contact pad 106 when the reverser mechanism 76 is actuated by the trigger 24. The trigger stabilizing ring 70 and the trigger return spring 76 both encircle this section of housing 112, which encloses the hammer 126. A hammer spring 128 extends from the closed end of the second section of housing 112 towards the hammer 126 which is disposed near the open end thereof. The outer diameter of the hammer 126 is less than the inner diameter of the first section of housing 110, with the forward end of the hammer 126 resting partially therein. The hammer 126 includes a receptacle 132 in which a spring 134 and a steel ball 136 are disposed. The spring 134 presses the steel ball 136 against the interior surface of the second section of housing 112. When the first section of housing 110 is compressed into the second section of housing 112, the steel ball 136 is caught at the rear edge of the first section of housing 110 until pressure on the ball 136 from the ball depression ramp 137, disposed within housing 112, forces the steel ball 136 to recess into the receptacle 132. Upon release, the hammer 126 is thrust forward, impacting the striker 48. In turn, the striker 48 is thrust into the breech chamber for purposes of striking ammunition therein. Thus, movement of the trigger 24 towards the handle 22 when the first notch 84 is engaged results in actuation of the reverser mechanism 78, which in turn actuates the firing mechanism 74 to cause the striker 48 to strike loaded ammunition, thereby firing the projectile weapon 10.

Thus, an improved projectile weapon in the form of a baton is disclosed. While embodiments of this invention have been shown and described, it will be apparent to those skilled in the art that many more modifications are possible without departing from the inventive concepts herein. The invention, therefore, is not to be restricted except in the spirit of the following claims.

What is claimed is:

1. A projectile weapon comprising:

an elongate tubular body having a barrel portion and a receiver portion, the receiver portion including a breech assembly disposed adjacent the barrel portion;

a handle affixed to the receiver portion of the elongate tubular body and extending outward from the elongate tubular body;

a firing mechanism disposed within the receiver portion of the elongate tubular body adjacent the breech assembly; and a trigger assembly adapted to slide in a longitudinal direction relative to the elongate tubular body, the trigger assembly including a trigger extending outwardly from the elongate tubular body in a direction generally parallel to the handle, wherein the trigger assembly is slidable between at least a deployed position and a non-deployed retracted position, wherein in the deployed position the trigger assembly is adapted to actuate the firing mechanism, and in the non-deployed retracted position the trigger is substantially fully recessed into the handle.

2. The projectile weapon of claim 1, the breech assembly being adapted to pivot outward from a first side of the elongate tubular body between at least a closed position and an open position.

3. The projectile weapon of claim 2, the breech assembly being securable in the closed position.

4. The projectile weapon of claim 2, wherein in the closed position the breech assembly is adapted to position ammunition adjacent the firing mechanism.

5. The projectile weapon of claim 2, wherein in the open position, the breech assembly is adapted to receive ammunition.

6. The projectile weapon of claim 2, wherein the handle and the portion of the trigger assembly extend outward from a second side of the elongate tubular body.

7. The projectile weapon of claim 6, wherein the second side of the elongate tubular body is opposite the first side.

8. The projectile weapon of claim 1, wherein the trigger is securable in the retracted position.

9. The projectile weapon of claim 1 further comprising a breech block disposed within the receiver portion of the elongate tubular body adjacent the breech assembly, the firing mechanism extending through the breech block and the breech block including a spring-biased lever extending toward the barrel portion.

10. A projectile weapon comprising:

an elongate tubular body having a forward barrel portion and a rearward receiver portion, the receiver portion including a breech assembly disposed adjacent the barrel portion;

a handle affixed to the receiver portion of the elongate tubular body and extending outward from the elongate tubular body;

a firing mechanism disposed within the receiver portion of the elongate tubular body adjacent the breech assembly;

a trigger assembly slidably engaged to the elongate tubular body, the trigger extending outwardly from the elongate tubular body in a direction generally parallel to the handle; and a reverser mechanism disposed within the receiver portion of the elongate tubular body and comprising a tiring mechanism actuator, the reverser mechanism being coupled to the trigger and to the firing mechanism, wherein rearward movement of the trigger leads to forward movement of the firing mechanism actuator, thereby actuating the firing mechanism.

11. The projectile weapon of claim 10, the breech assembly being adapted to pivot outward from a first side of the elongate tubular body between at least a closed position and an open position.

12. The projectile weapon of claim 11, the breech assembly being securable in the closed position.

13. The projectile weapon of claim 11, wherein in the closed position the breech assembly is adapted to position ammunition adjacent the firing mechanism.

14. The projectile weapon of claim 11, wherein in the open position, the breech assembly is adapted to receive ammunition.

15. The projectile weapon of claim 11, wherein the handle and trigger extend outward from a second side of the elongate tubular body.

16. The projectile weapon of claim 15, wherein the second side of the elongate tubular body is opposite the first side.

17. The projectile weapon of claim 10, wherein the reverser mechanism is releasably coupled to the trigger.

18. The projectile weapon of claim 10, the reverser mechanism further comprising:

a first rack coupled to the trigger;

a second rack coupled to the firing mechanism; and a pinion disposed between and engaging the first and second racks.

19. The projectile weapon of claim 10 further comprising a breech block disposed within the receiver portion of the elongate tubular body adjacent the breech assembly, the firing mechanism extending through the breech block and the breech block including a spring-biased lever extending toward the barrel portion.

20. A projectile weapon comprising:

an elongate tubular body having a barrel portion and a receiver portion, the receiver portion including a breech assembly disposed adjacent the barrel portion;

a handle affixed to the receiver portion of the elongate tubular body and extending outward from the elongate tubular body;

a firing mechanism disposed within the receiver portion of the elongate tubular body adjacent the breech assembly;

a trigger adapted to slide in a longitudinal direction along the elongate tubular body and extending outwardly from the elongate tubular body in a direction generally parallel to the handle, the trigger being slidable between at least a deployed position and a retracted position, wherein in the retracted position the trigger is recessed into the handle; and a reverser mechanism disposed within the receiver portion of the elongate tubular body, the reverser mechanism being coupled to the trigger and to the firing mechanism, wherein the trigger is adapted to actuate the reverser mechanism when the trigger is in the deployed position, and the reverser mechanism is adapted to actuate the firing mechanism.

21. The projectile weapon of claim 20, the breech assembly being adapted to pivot outward from a first side of the elongate tubular body between at least a closed position and an open position.

22. The projectile weapon of claim 21, the breech assembly being securable in the closed position.

23. The projectile weapon of claim 21, wherein in the closed position the breech assembly is adapted to position ammunition adjacent the firing mechanism.

24. The projectile weapon of claim 21, wherein in the open position, the breech assembly is adapted to receive ammunition.

25. The projectile weapon of claim 21, wherein the handle and trigger extend outward from a second side of the elongate tubular body.

26. The projectile weapon of claim 25, wherein the second side of the elongate tubular body is opposite the first side.

27. The projectile weapon of claim 20, wherein the trigger assembly is securable in the retracted position.

28. The projectile weapon of claim 20, wherein the reverser mechanism is releasably coupled to the trigger.

29. The projectile weapon of claim 20, the reverser mechanism comprising:

a first rack coupled to the trigger;

a second rack coupled to the firing mechanism; and a pinion disposed between and engaging the first and second racks.

30. The projectile weapon of claim 20 further comprising a breech block disposed within the receiver portion of the elongate tubular body adjacent the breech assembly, the firing mechanism extending through the breech block and the breech block including a spring-biased lever extending toward the barrel portion.

31. A projectile weapon comprising:

an elongate tubular body having a barrel portion and a receiver portion, the receiver portion including a breech assembly disposed adjacent the barrel portion, wherein the breech assembly is adapted to pivot outward from a first side of the elongate tubular body between at least a closed position and an open position;

a handle affixed to the receiver portion of the elongate tubular body, the handle extending outward from the elongate tubular body;

a breech block disposed within the receiver portion of the elongate tubular body adjacent the breech assembly, the breech block including a spring-biased lever extending toward the barrel portion;

a firing mechanism disposed within the receiver portion of the elongate tubular body and extending through the breech block to adjacent the breech assembly;

a trigger adapted to slide in a longitudinal direction along the elongate tubular body and extending outwardly from the elongate tubular body in a direction generally parallel to the handle, the trigger being slidable between at least a deployed position and a retracted position, wherein in the retracted position the trigger is recessed into the handle;

a first rack disposed within the receiver portion of the elongate tubular body and releasably coupled to the trigger, wherein in the deployed position the trigger is adapted to actuate the first rack;

a second rack disposed within the receiver portion of the elongate tubular body and coupled to the firing mechanism; and a pinion disposed between and engaging the first and second racks.

32. The projectile weapon of claim 31, the breech assembly being securable in the closed position.

33. The projectile weapon of claim 31, wherein in the closed position the breech assembly is adapted to position ammunition adjacent the firing mechanism.

34. The projectile weapon of claim 31, wherein in the open position, the breech assembly is adapted to receive ammunition.

35. The projectile weapon of claim 31, wherein the handle and trigger extend outward from a second side of the elongate tubular body.

36. The projectile weapon of claim 35, wherein the second side of the elongate tubular body is opposite the first side.

37. The projectile weapon of claim 31, wherein the trigger is securable in the retracted position.

* * * * *